US007810914B2

(12) United States Patent
Owaki

(10) Patent No.: US 7,810,914 B2
(45) Date of Patent: Oct. 12, 2010

(54) LIQUID JET HEAD AND LIQUID JET DEVICE

(75) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 12/201,808

(22) Filed: Aug. 29, 2008

(65) Prior Publication Data

US 2009/0058935 A1 Mar. 5, 2009

(30) Foreign Application Priority Data

Aug. 30, 2007 (JP) ..... 2007-224844

(51) Int. Cl.
*B41J 2/45* (2006.01)

(52) U.S. Cl. ..... 347/68; 347/71

(58) Field of Classification Search ..... 347/68–72
See application file for complete search history.

(56) References Cited

U.S. PATENT DOCUMENTS 7,165,828 B2 * 1/2007 Murakami et al. ..... 347/44
7,198,360 B2 * 4/2007 Watanabe et al. ..... 347/71
2007/0165070 A1 7/2007 Honma et al.

FOREIGN PATENT DOCUMENTS

JP 2001-293860 10/2001
JP 2005-096419 4/2005

* cited by examiner

*Primary Examiner*—Lamson D Nguyen
(74) *Attorney, Agent, or Firm*—Workman Nydegger

(57) ABSTRACT

A liquid jet head includes head modules each having a nozzle plate with a nozzle orifice and a passage-forming substrate having a pressure-generating chamber. The chamber communicates with the associated nozzle orifice and is pressurized by the pressure generating element so as to eject droplets. A head case is placed at the side of the passage-forming substrate opposite to the nozzle plate and has flow paths for providing a liquid to the pressure-generating chambers. The liquid jet head includes a fixing plate that has openings through which the nozzle orifices are exposed and carries the head modules positioned thereon. A connecting member is connected to the surface of the head module adjacent to the head case and has flow paths which communicate with the pressure-generating chambers. A reinforced portion made of an adhesive filling a clearance is positioned between adjacent head modules fixed to the fixing plate.

7 Claims, 14 Drawing Sheets

LIQUID JET HEAD AND LIQUID JET DEVICE

CROSS-REFERENCE TO RELATED APPLICATIONS

The present application is based on and claims priority from Japanese Patent Application No. 2007-224844 on Aug. 30, 2007, the contents of which are incorporated herein by reference.

BACKGROUND

1. Technical Field

The present invention relates to a liquid jet head and a liquid jet device.

2. Related Art

A liquid jet head has been known which ejects droplets from nozzle orifices by pressurizing liquid using pressure generating mechanism such as a piezoelectric element or a heater element. A typical example of such liquid jet head is an ink jet recording head for ejecting ink droplets. For instance, JP-A-2005-096419 discloses a unit as an example of such foregoing ink jet recording head (unit). This unit includes, for example, head modules each having a nozzle plate or the like having nozzle orifices formed therethrough, and a passage-forming substrate having a pressure-generating chamber formed therein, the nozzle plate being joined to the passage-forming substrate, the head modules being covered with a head case and bonded to a fixing plate.

Also, for instance, JP-A-2001-293860 discloses an ink jet recording device having such foregoing ink jet recording head mounted thereon. The recording device has a cap member for closing a nozzle surface in which nozzle orifices of the ink jet recording head open, wherein viscous ink residue is forcibly removed, for example, by performing a sucking operation to suck the interior of the cap member covering the nozzle surface, so that nozzle orifice blockage is prevented.

However, as described above, the ink jet recording head has the plurality of the head modules fixed at a predetermined interval on the fixing plate. In other words, there is a clearance between the adjacent head modules fixed to the fixing plate. Therefore, when the cap member is brought into contact with an ink-ejecting surface of the ink jet recording head, deformation (curving) of the fixing plate may occur, causing misalignment of the nozzle orifices of different modules. Failing in alignment of the nozzle orifices impairs ink-droplet landing accuracy and disadvantageously degrades printing quality.

SUMMARY

An advantage of some aspects of the invention is that the deformation of the fixing plate is prevented so as to maintain the high ink-droplet landing accuracy over a long period of service.

According to an aspect of the present invention, the liquid jet head and the liquid jet device of the invention includes a plurality of head modules each having a nozzle plate with nozzle orifice formed therein, a passage-forming substrate having pressure-generating chamber therein, the chamber communicating with the associated nozzle orifice and pressurized by pressure generating element so as to eject droplets, and a head case placed at the side of the passage-forming substrate opposite to the nozzle plate, the head case having flow paths for providing a liquid to the pressure-generating chambers. The liquid jet head further includes a fixing plate having openings through which the nozzle orifice are exposed and carrying the head modules positioned and fixed thereon, a connecting member to which the surface of the head module adjacent to the head case is connected, the connecting member having flow paths which communicate with the pressure-generating chambers, and a reinforced portion made of an adhesive filling a clearance between adjacent head modules fixed to the fixing plate, wherein the fixing plate has a side wall portion protruding heightwise from the periphery of the bottom portion thereof, wherein the reinforced portion is also provided in a clearance between the side wall portion and the head modules, and wherein the height of the side wall portion is smaller than that of the head modules. Other features and objects of the invention will become clear from the following description herein with reference to the accompanying drawings.

BRIEF DESCRIPTION OF THE DRAWINGS

For a more complete understanding of the invention and the advantages thereof, reference is now made to the following descriptions in conjunction with the accompanying drawings.

DETAILED DESCRIPTION OF PREFERRED EMBODIMENTS

Figure 1:
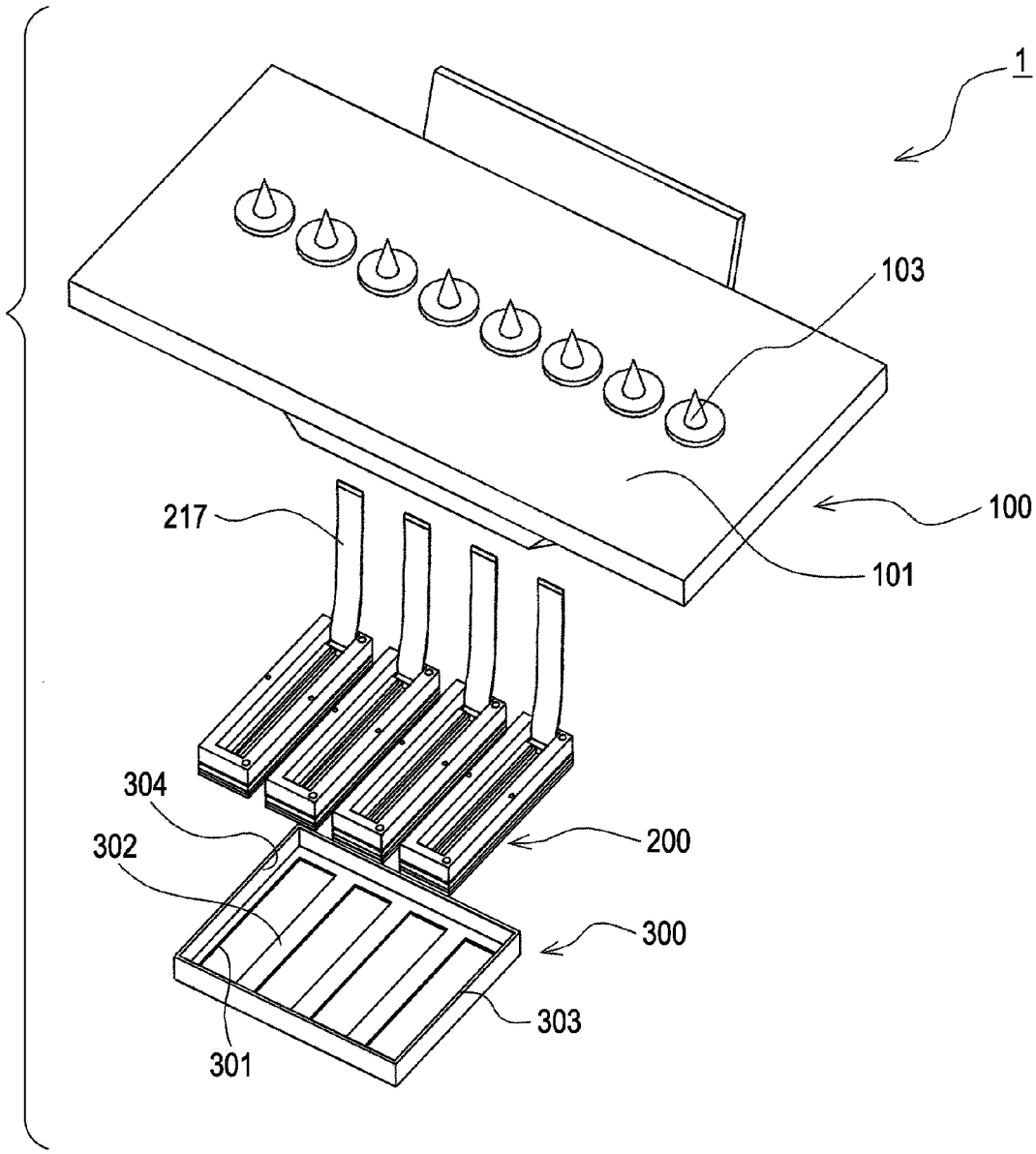
FIG. 1 is an exploded perspective view of a recording head according to a first embodiment.

At least followings will become clear from the description herein and the accompanying drawings. A liquid jet head includes a plurality of head modules each having a nozzle plate with nozzle orifices formed therein, a passage-forming substrate having pressure-generating chambers therein, the chambers communicating with the associated nozzle orifices and pressurized by pressure generating elements so as to eject droplets, and a head case placed at the side of the passage-forming substrate opposite to the nozzle plate, the head case having flow paths for providing a liquid to the pressure-generating chambers. The liquid jet head further includes a fixing plate having openings through which the nozzle orifices are exposed and carrying the head modules positioned and fixed thereon and a connecting member to which the surface of the head module adjacent to the head case is connected, the connecting member having flow paths which communicate with the pressure-generating chambers. In the liquid jet head, a reinforced portion is provided, which is made of an adhesive and filling a clearance between adjacent head modules fixed to the fixing plate, and the reinforced portion is also provided in a clearance between a side wall portion of the fixing plate, which projects heightwise from the periphery of the bottom portion thereof, wherein the height of the side wall portion is smaller than that of the head modules.

In the present invention, the stiffness of the fixing plate is substantially enhanced by the reinforced portion, thus deformation of the fixing plate is suppressed even when, for example, a cap member touches to the nozzle surface where nozzle orifices open. Moreover, forming the side wall portion of the fixing portion with its height smaller than that of the head modules prevents the side wall portion from being deformed during forming the reinforced portion. Therefore, misalignment of the nozzle orifices of the different modules is prevented so that high ink-droplet landing accuracy is maintained for a long period of service.

Also, it is preferable that the side wall portion is tall enough to reach the head case. This enables the reinforced portion to protect piezoelectric elements, thereby suppressing breakage of the piezoelectric elements caused by paper jamming.

It is also preferable that the adhesive forming the reinforced portion has a lower viscosity in un-cured state and a lower hardness in cured state than those of an adhesive used for attaching the fixing plate to the nozzle plate. This feature makes it possible to suppress the deformation of the fixing plate in connection with cure shrinkage of the adhesive which forms the reinforced portion, as well as efficiently form the reinforced portion.

Additionally, it is preferable that at least part of the reinforced portion has a laminated structure composed of a plurality of layers of different adhesives, the adhesive forming a layer closer to the bottom of the fixing plate having a hardness greater than that of the adhesive forming a layer adjacent to the head case in cured state. This feature makes it possible to further suppress the deformation of the fixing plate caused by the cure shrinkage of the adhesive forming reinforced portion, while substantially enhancing the stiffness of the fixing plate so as to suppress the deformation of the fixing plate.

It is also preferable that the reinforced portion includes a first layer closer to the bottom of the fixing plate and a second layer closer to the head case, the first layer being formed of an adhesive having higher hardness in cured state than an adhesive forming the second layer, the first layer being formed to have a thicknesswise height which does not allow the first layer to reach the head case. This feature makes it possible to further suppress the deformation of the fixing plate caused by the cure shrinkage of the adhesive forming reinforced portion, as well as suppress the deformation of the fixing plate caused by contacting with, for example, the cap member.

Alternatively, it is preferable that the reinforced portion includes a first layer closer to the bottom of the fixing plate and a second layer closer to the head case, the first layer being formed of an adhesive having higher hardness in cured state than an adhesive forming the second layer, and the reinforced portion provided in the clearance between the side wall portion and the head modules is formed only of the first layer. This feature makes it possible to suppress the deformation of the fixing plate caused by the cure shrinkage of the adhesive forming reinforced portion as well as further suppress the deformation of the fixing plate caused by contacting with, for example, the cap member.

Also, a liquid jet device is disclosed, which has the liquid jet head of the type described. With such a structure, it is possible to implement a liquid jet device with highly durable and reliable liquid jet heads.

The preferable embodiments of the present invention is described below with reference to the accompanying drawings. Note that the embodiments described below are illustrated as exemplary embodiments and not all elements illustrated below are necessary in the present invention.

DESCRIPTION OF EXEMPLARY EMBODIMENTS

First Embodiment

Figure 2:
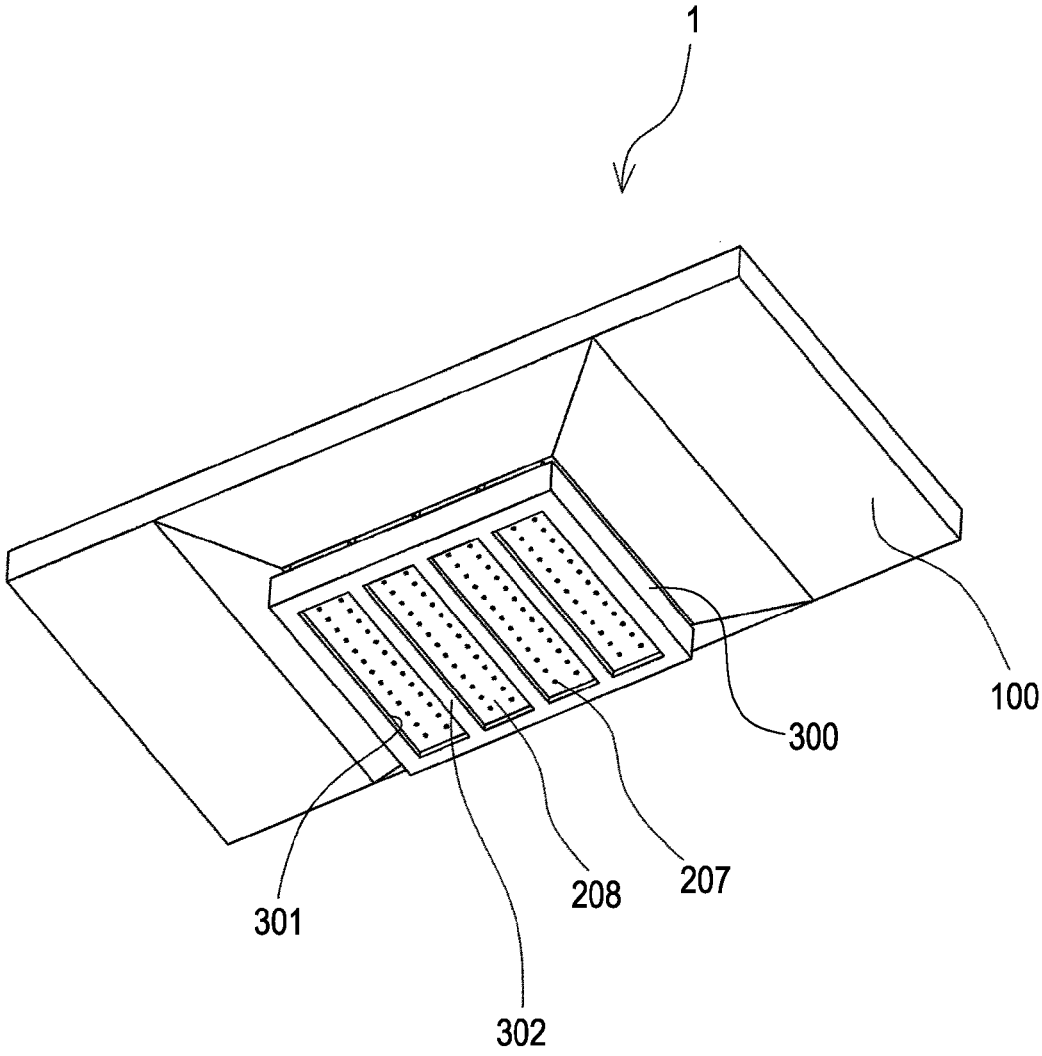
FIG. 2 is a perspective assembly view of the recording head according to the first embodiment.
Figure 3:
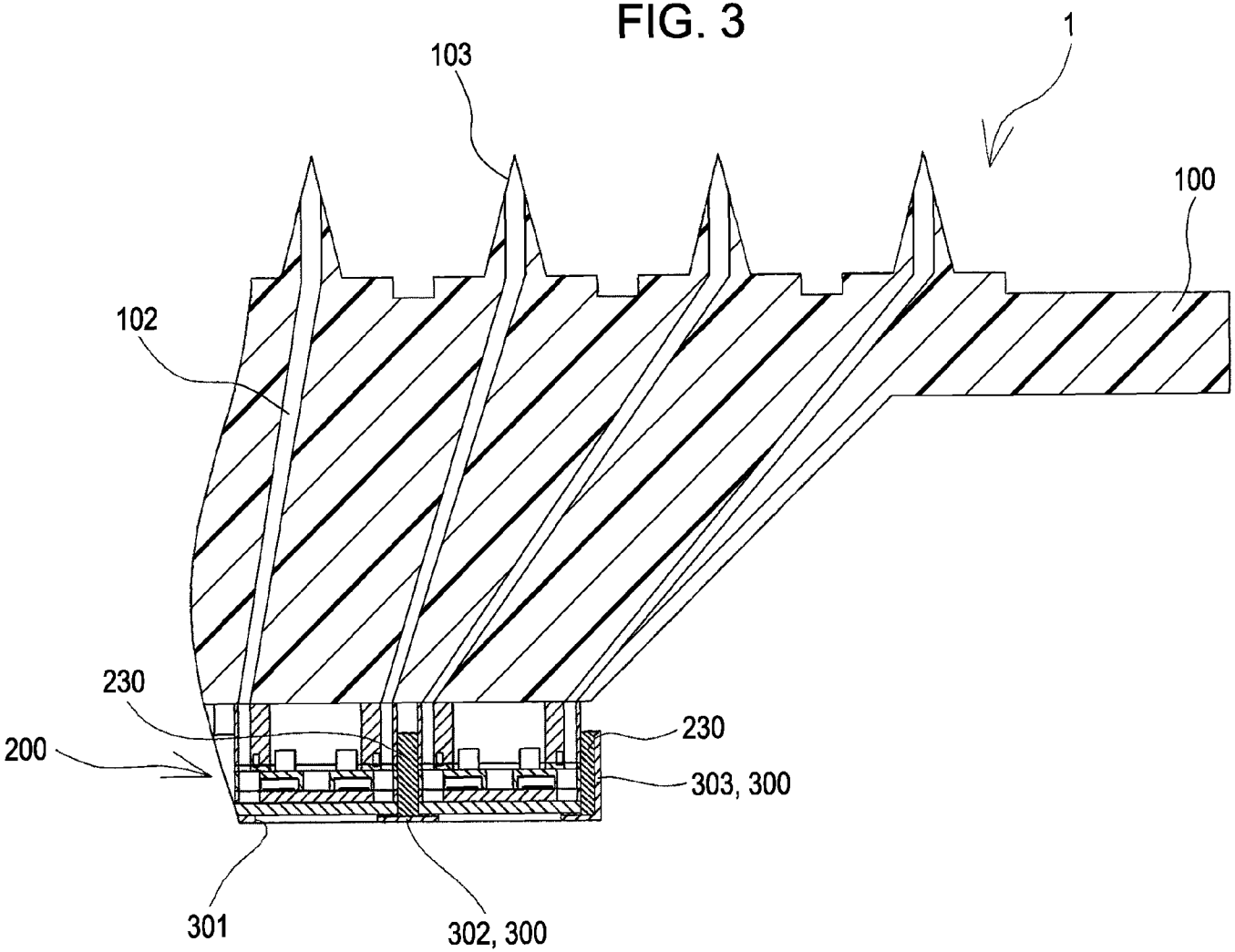
FIG. 3 is a sectional view of a critical part of the recording head according to the first embodiment.

FIG. 1 is an exploded perspective view showing an ink jet recording head according to a first embodiment of the present invention. FIG. 2 is a perspective assembly view of the ink jet recording head. FIG. 3 is a sectional view of a critical part of the ink jet recording head.

An ink jet recording head (herein after referred to as "recording head") 1 shown in the drawings includes a cartridge case 100 serving as a connecting member, an ink jet recording head module (herein after referred to as "recording head module") 200, a fixing plate 300 which is adhered to nozzle plates 208 and thus carrying a plurality of recording head modules 200 positioned and fixed thereon. The cartridge case 100 is formed of, for example, resin material and has a cartridge mounting part 101 on which ink cartridges (not shown) serving as ink supplying units (liquid supplying units) are mounted. The cartridge case 100 has a plurality of ink communicating paths 102 formed therein. Each of the ink communicating paths 102 has its one end open to the cartridge mounting part 101 and the other end open to the surface adjacent to the recording head module 200. An ink supply needle to be inserted into an ink cartridge is provided on the cartridge mounting part 101 at a position where each communication path opens.

On the bottom surface of the cartridge case 100, the recording head modules 200 (4 modules in the illustrated case) are fixed at a predetermined interval so as to form the recording head 1. Each of the recording head modules 200 of the recording head 1 is provided in accordance with each color of the inks, respectively. Additionally, the recording head modules 200 are bonded to the fixing plate 300, being positioned with respect to one another. Being positioned in this manner, each of the recording head modules 200 is fixed to the bottom surface of the cartridge case 100.

Figure 4:
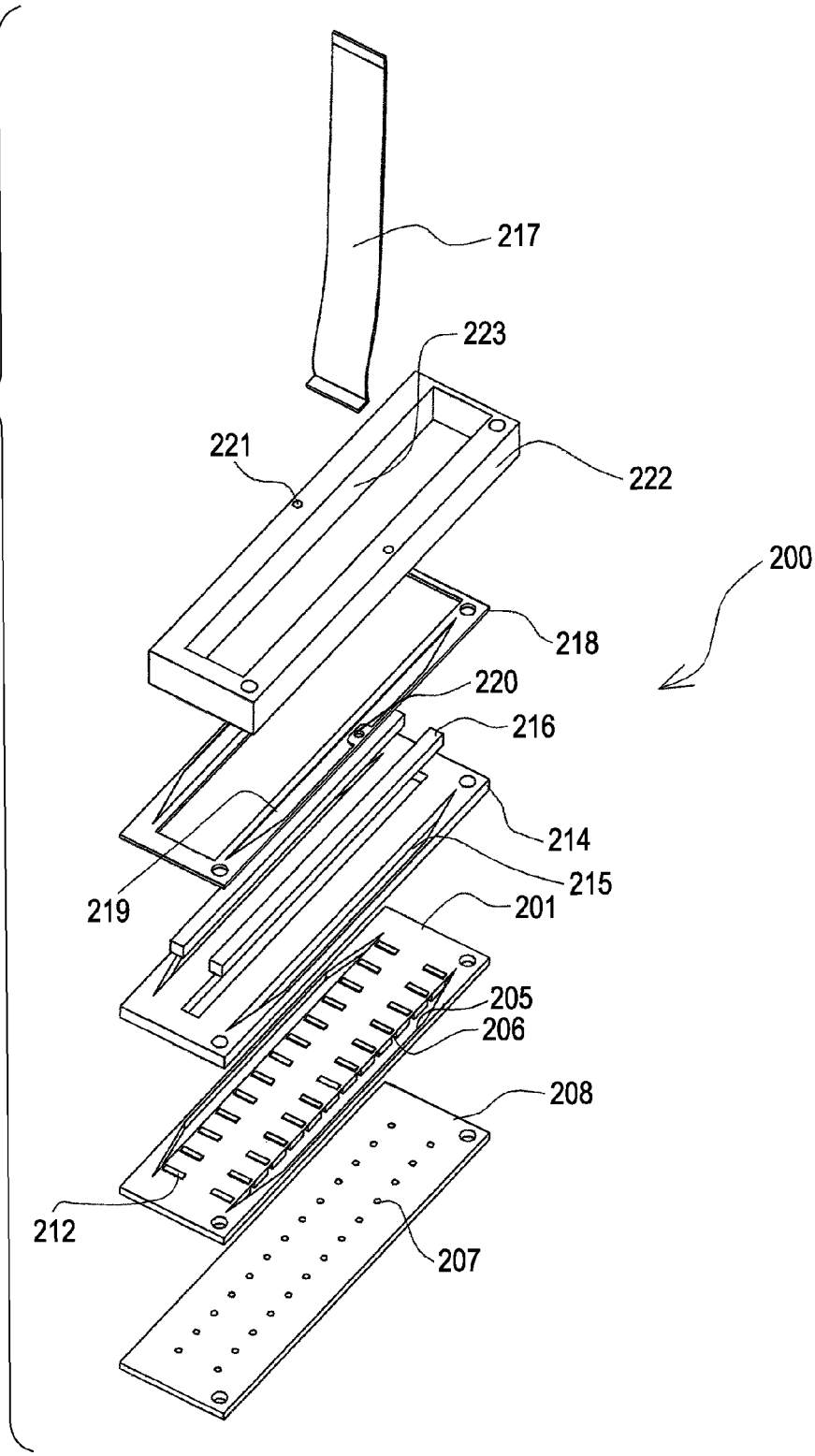
FIG. 4 is an exploded perspective view of the recording head module according to the first embodiment.
Figure 5:
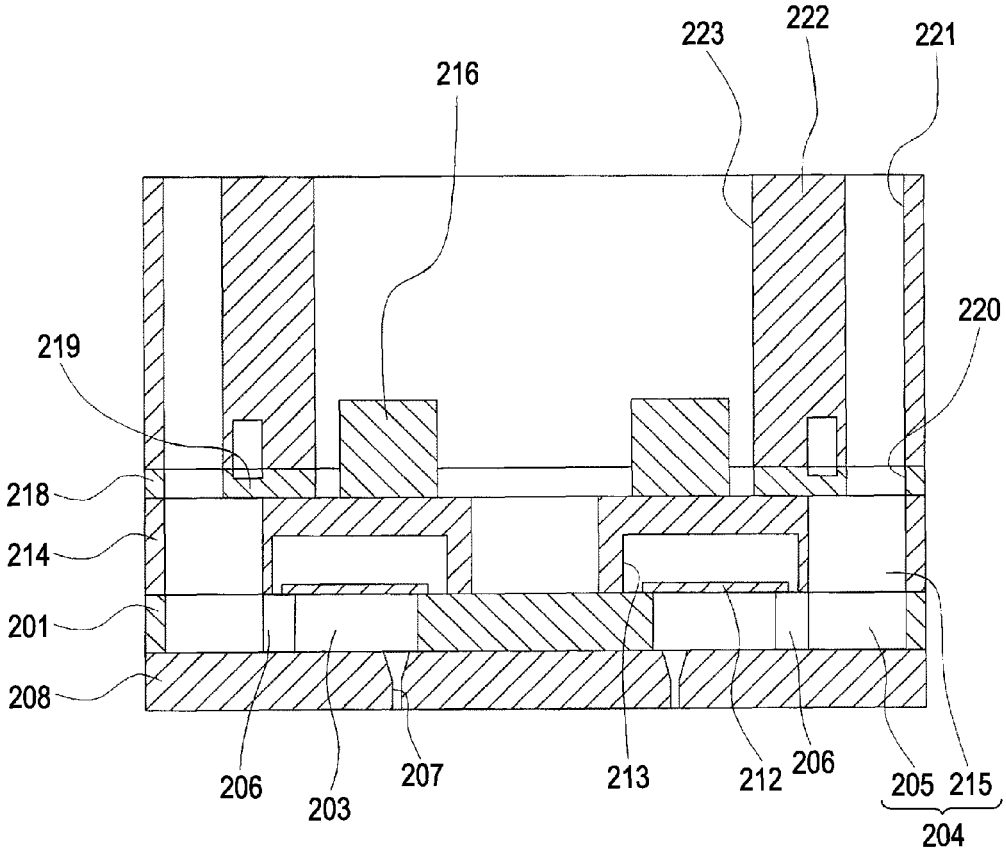
FIG. 5 is a sectional view of the recording head module according to the first embodiment.
Figure 6:
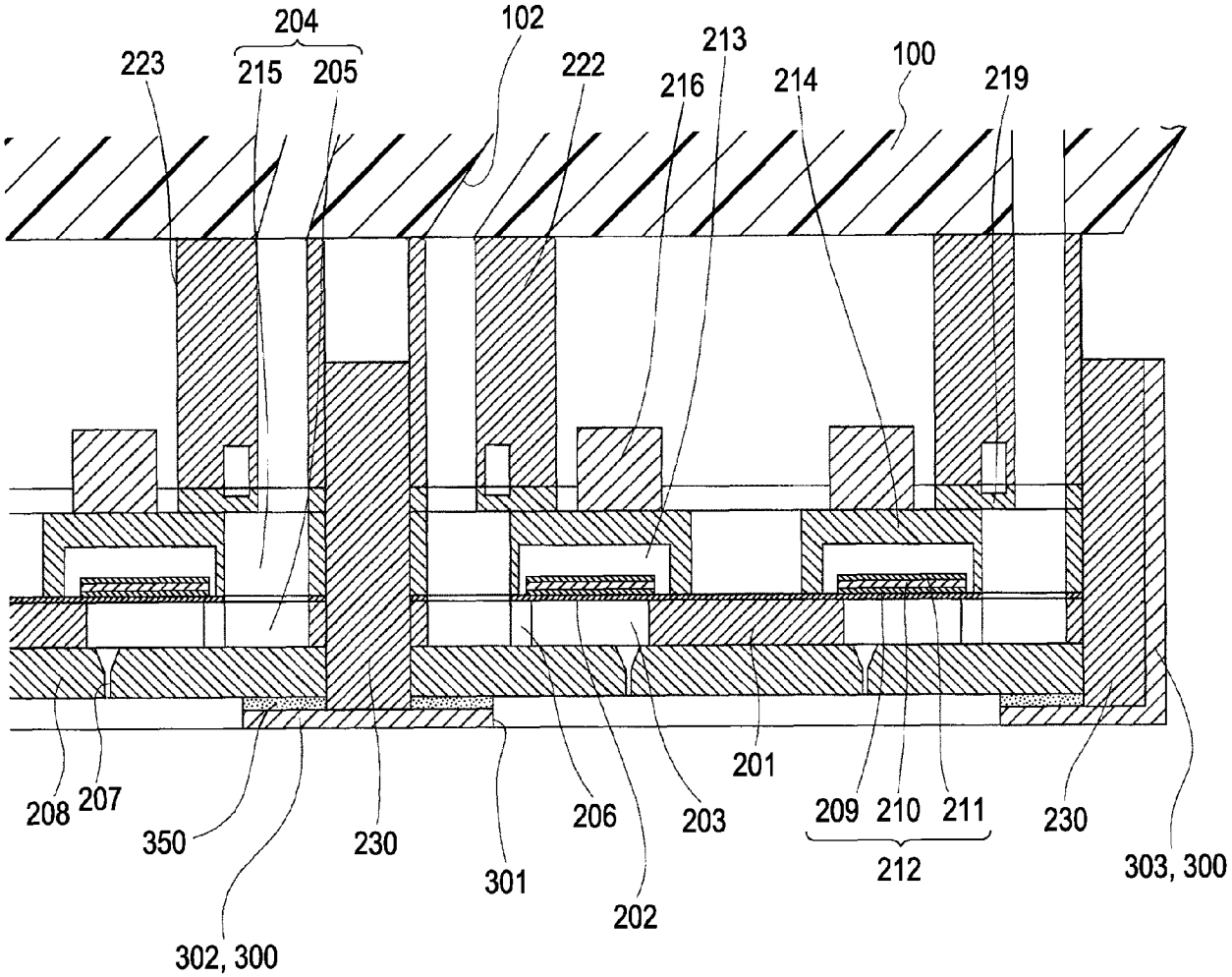
FIG. 6 is a sectional view of the critical part of the recording head according to the first embodiment.

Here, the structure of the recording head module 200 will now be described. FIG. 4 is an exploded perspective view of the recording head module, FIG. 5 is a sectional view of the recording head module, and FIG. 6 is a sectional view of the critical part of the recording head module. As shown in FIGS. 4 to 6, an elastic film 202 is formed on one surface of a passage-forming substrate 201 included in the recording head module 200. Also, a plurality of pressure-generating chambers 203 are formed in the passage-forming substrate 201. For example, according to this embodiment, two arrays of the pressure-generating chambers 203 are formed so as to oppose to each other in the direction of width of the substrate 201. Also, at the outside of the two arrays of the pressure-generating chambers 203, communicating portions 205 are formed to extend in the longitudinal direction of the substrate 201. Each of the communicating portions 205 communicates with a reservoir portion provided in a later described substrate. Each communicating portion and the associated reservoir portion in combination form a reservoir 204 which serves as an ink chamber common to the pressure-generating chambers 203 of each array. Moreover, the communicating portion 205 communicates with one longitudinal end portion of each of the pressure-generating chambers 203 via an ink supply path 206.

A nozzle plate having nozzle orifices 207 pierced therethrough is fixed to the underside of the passage-forming substrate 201 by means of, for example, an adhesive or a hot melt.

Meanwhile, piezoelectric elements 212 are formed on a surface of the passage-forming substrate 201. Each piezoelectric element 212 includes a lower electrode film 209, a piezoelectric material layer 210 made of, for example, lead-zirconate-titanate (PZT) or the like, and an upper electrode film 211.

On the passage-forming substrate 201 on which such piezoelectric elements 212 are formed, a substrate 214 is joined, the substrate 214 having piezoelectric element holding portions 213 receiving the piezoelectric elements 212 therein at regions corresponding to the piezoelectric elements 212. Also, the aforementioned reservoir portion, denoted by 215, is formed in this substrate 214. The reservoir portion 215 forms, together with the communicating portion 205 of the passage-forming substrate 201 communicating therewith, the reservoir 204 which serves as the ink chamber common to the pressure-generating chambers 203, as described before.

On the substrate 214, drive ICs 216 for driving the piezoelectric elements 212 are mounted. Terminals of each of the driving ICs 216 are connected to respective lead electrodes extending from individual electrodes of the piezoelectric elements 212 via bonding wires or the like (not shown). Other terminals of the drive IC 216 are connected to an external wiring 217 such as a flexible print cable (FPC) as shown in FIG. 1, through which various signals such as print signals are received.

A compliance substrate 218 is joined to the substrate 214. Portions of the compliance substrate 218 corresponding to the reservoirs 204 are locally thin-walled to provide flexible portions 219. Deforming the flexible portion 219 absorbs the change of the pressure in the reservoir 204. Additionally, in the compliance substrate 218, ink introducing ports 220 are formed in communication with the reservoir 204.

A head case 222 is joined to the upper side of the compliance substrate 218. In the head case 222, ink supply communicating paths 221 are provided in communication with the ink introducing ports 220 and the ink communicating paths 102 of the cartridge case 100. Via the ink communicating path 102, the ink supply communicating path 221 and the ink introducing port 220, ink is supplied into each reservoir 204. Also, in the head case 222, at a region facing the driving ICs 216, a drive IC holding portion 223 is provided, which penetrates the head case 222 in its thickness direction. The drive IC holding portion 223 is filled with a potting material (not shown) so that the drive ICs 216 are covered with the potting material.

In the recording head module 200, ink is filled in through the ink supply communicating paths 221 to the nozzle orifices 207. After that, in accordance with a recording signal from the drive ICs 216, voltages are applied to the associated piezoelectric elements 212 corresponding to the pressure-generating chambers 203. Thus, the elastic film 202 and the piezoelectric elements 212 are flexibly deformed to pressurize the ink in the pressure-generating chambers 203, so that the ink droplets are ejected from the nozzle orifices 207.

Such recording head modules 200 are positioned with respect to one another and bonded at a predetermined interval to the fixing plate 300 (see FIG. 6). In the fixing plate 300, opening portions 301 through which the nozzle orifices 207 are exposed are provided, each of the opening portions 301 corresponding to, for example, each of the recording head modules 200. More specifically, beam portions 302 are provided at regions corresponding to regions between the adjacent recording modules 200 and the opening portions 301 are provided corresponding to the recording head modules 200. Each of the recording head modules 200 is joined at the peripheral part of the nozzle plate 208 to the fixing plate 300 having the beams 302, by means of an adhesive 350. Additionally, the beam portions 302 of the fixing plate 300 serve to prevent ink from reversely entering from the ink ejecting direction to the clearance between adjoining recording head modules 200. Also, by providing the beam portion 302, the region used for adhering is provided over the entire periphery of each nozzle plate 208 of the recording head module 200 without fail.

The fixing plate has a peripheral side wall portion of a height smaller than that of the recording head module 200. The side wall portion 303 is exposed, so that an external surface of the side wall portion 303 opposite to an internal surface facing the head cases 222 forming a part of the recording head modules 200 is kept from contacting any member. For example, the fixing plate 300 according to the embodiment has a substantially box-shaped structure opened at its one side and having a concaved portion 304 surrounded and defined by the side wall portion 303 (see FIG. 1). The nozzle plates 208 of the recording head modules 200 are bonded to the bottom surface of the concaved portion 304.

In the clearance between adjoining recording head modules 200 bonded to the fixing plate 300 at a predetermined interval, a reinforced portion 230 made of a certain kind of adhesive is provided. Also, the reinforced portion 230 is provided to continuously fill the peripheral space inside the side wall portion 303 of the fixing plate. In other words, the reinforced portion 230 is also provided in the clearance between the side wall portion 303 of the fixing plate 300 and the recording head modules 200. The reinforced portion 230 is formed by filling, after positioning and bonding the recording head modules 200 to the fixing plate 300, the concaved portion 304 of the fixing plate 300 with the certain kind of adhesive, and allowing the adhesive to cure. The adhesive mentioned above may include, for example, a so called mold material used for protecting wires or other purposes.

By providing such reinforced portion 230, stiffness of the fixing plate 300 is substantially improved and, a deformation of the fixing plate 300 caused by, for example, a contact with any other member during a sucking operation can be prevented. Also, in the present invention, the height of the side wall portion 303 of the fixing plate 300 on which the recording head modules 200 are positioned and fixed is smaller than the height of the recording head modules 200. That is to say, the side wall portion 303 is formed with such a height that the side wall portion 303 does not touch the cartridge case 100 and a part of the recording head modules 200 is exposed through the clearance between the side wall portion 303 and the cartridge case 100. More specifically, the head case 222 forming part of the recording head module 200 is partially exposed through the above-mentioned clearance. Therefore, the recording head modules 200 can be grasped and positioned with high accuracy on the fixing plate 300. This also suppresses any deflecting tendency of the fixing plate 300 which otherwise may be caused by surplus adhesive during forming the reinforced portion 230 by filling adhesive in the clearance between the recording head modules 200 and the side wall portion 303.

In addition, the reinforced portion 230 is formed to extend from the level of the side surfaces of the nozzle plates 208 to a certain level below the upper end of the head case 222. There are various members laminated in between the nozzle plate 208 and the head case 222, and in case liquid is leaking from joints between them, the reinforced portion 230 also prevents the leaking.

Here, in a typical fixing plate, for example, a side wall portion of the fixing plate (nozzle cover) is adhered to the cartridge case, i.e. the side wall portion is higher than the recording head modules (see, for example, JP-A-2004-284255). In such a structure wherein the fixing plate is joined to the cartridge case, the recording head modules can be fixed firmly. However, introducing such a typical structure into the structure having the reinforced portion 230 might cause deterioration of the printing quality, as described below.

Figure 7A:
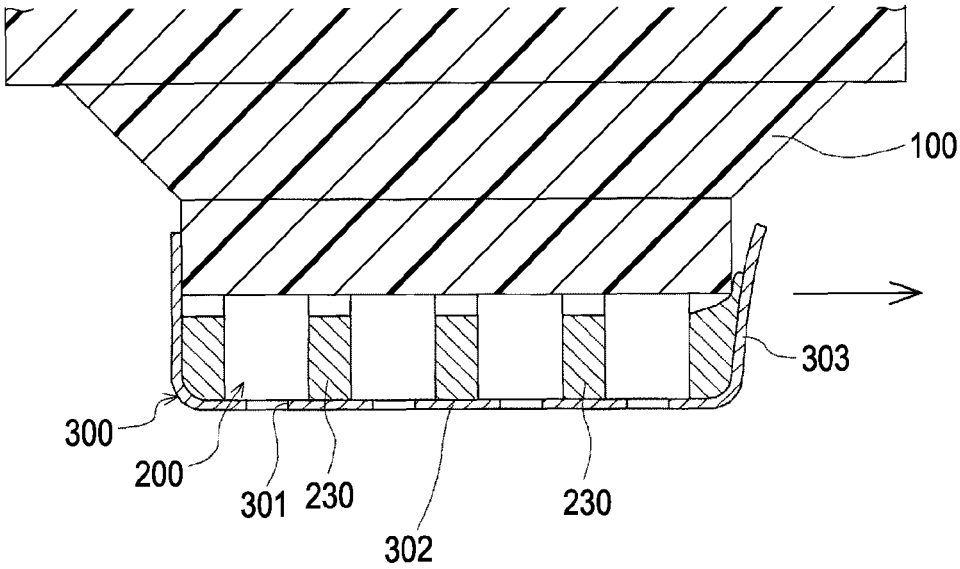
FIG. 7A is a schematic illustration of a known recording head, showing specifically a deformation of a side wall portion of a fixing plate.

The reinforced portion 230 is formed by, for example, fixing the recording head modules 200 joined to the fixing plate 300 to the cartridge case 100, and then, filling, by means of a syringe or the like, the adhesive into the clearance between the side wall portion 303 of the fixing plate 300 and the recording head modules 200, as well as the clearances between adjacent recording head modules 200. In this procedure, forming the side wall portion 303 of the fixing plate 300 to have a thicknesswise height so as to reach the cartridge case 100 leads to the problem that surplus adhesive might enter the small gap between the cartridge case 100 and the fixing plate 300 and deform the side wall portion 303 outwardly, as shown in FIG. 7A. The deformation of the side wall portion 303 causes a warp in the bottom surface (where the opening portions 301 are formed) of the fixing plate 300. This causes a variation in the distance between the nozzle orifices and a recording medium, resulting in the deterioration of the printing quality.

Figure 7B:
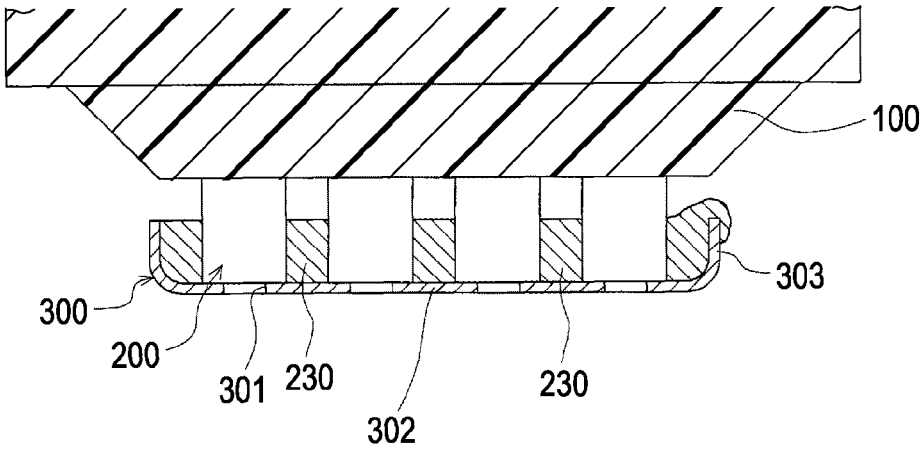
FIG. 7B is a schematic illustration similar to that of FIG. 7A but showing, for the purpose of the comparison, a recording head in accordance with the present invention.

In contrast, according to the present invention, the side wall portion 303 is lower than the recording head modules 200, so the above mentioned problems will not occur. That is to say, when filling the adhesive into the clearance between the recording head modules 200 and the side wall portion 303, as shown in FIG. 7B, any surplus adhesive will escape to the outside of the side wall portion 303 and cure without causing deformation of the side wall portion 303. Additionally, according to the present invention, each recording head module 200 can be fixed to the fixing plate 300 firmly by providing the reinforced portion 230, despite the fact that the fixing plate 300 is not fixed to the cartridge case 100.

Figure 8A:
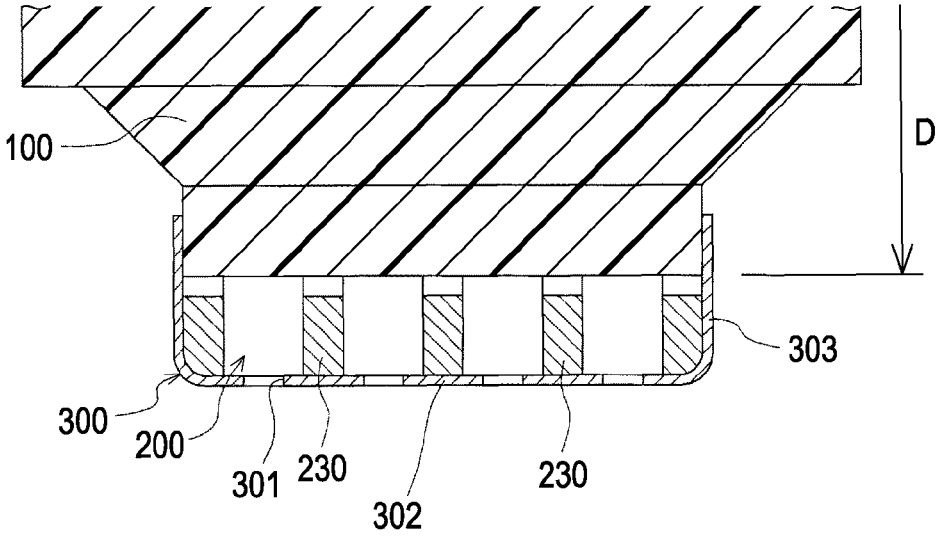
FIG. 8A is a schematic illustration of another known recording head.
Figure 8B:
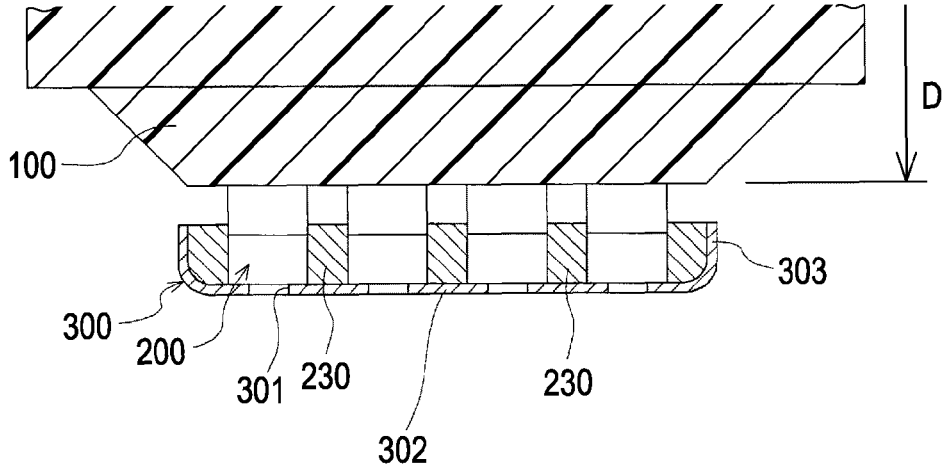
FIG. 8B is a schematic illustration similar to that of FIG. 8A but showing, for the purpose of the comparison, a recording head in accordance with the present invention.

Moreover, when the side wall portion 303 is fixed to the cartridge case 100, a portion to which the side wall portion 303 is to be fixed needs to be prepared on the cartridge case 100. As a result, for example, the cartridge case 100 needs to have a relatively large thickness D, as shown in FIG. 8A. In contrast, according to the present invention, because the side wall portion 303 is lower than the recording head modules 200, the portion to which the side wall portion 303 is to be fixed does not need to be prepared so that the thickness D of the cartridge case 100 can be very small, as shown in FIG. 8B. In other words, it is possible to miniaturize the ink jet recording head 1.

Additionally, it is preferable that the side wall portion 303 is relatively lowered, however, it is desirable that the side wall portion 303 has a height large enough to reach the head case 222 (see FIG. 6), whereby the recording modules 200 can be fixed to the fixing plate 300 with adequate strength. Therefore, breakage of the recording head modules 200 is prevented even when, for example, a paper jam occurs. Moreover, forming the side wall portion 303 to be lower than the upper surface of the recording head modules 200 can shorten the length of the syringe for filling the adhesive. Therefore, it facilitates filling adhesive and also prevents the blockage in the syringe.

Additionally, types of the adhesives forming the reinforced portion 230 are not limited specifically. However, it is preferable that the adhesive has lower viscosity and higher liquidity in un-cured state and lower hardness in cured state than those of an adhesive 350 used for attaching the recording head modules 200 (nozzle plates 208) to the fixing plate 300. For example, in this embodiment, a silicone adhesive is used as the adhesive for forming the reinforced portion 230, while an epoxy adhesive is used as the adhesive 350 for attaching the recording head modules 200 to the fixing plate 300.

Using the adhesive with relatively lower viscosity in uncured state as the adhesive forming the reinforced portion 230 enables the adhesive to flow into the clearances between adjacent recording head modules 200 without fail even when the clearances are small, so that the reinforced portion 230 can be well formed. Also, using the adhesive with relatively lower hardness in cured state as the adhesive forming the reinforced portion 230 can prevent the deformation of the fixing plate 300 in connection with cure shrinkage of the adhesive. That is, the adhesive with relatively lower hardness in cured state shrinks only slightly when cures, so forming the reinforced portion 230 with such an adhesive can greatly suppress any deformation of the fixing plate 300 in connection with the shrinkage of the adhesive.

Additionally, types of the material of the fixing plate 300 are not limited specifically. However, it is preferable that the fixing plate 300 has lower or the same linear expansivity as that of the portion of the recording head modules 200, which is to be fixed to the fixing plate 300, i.e. the nozzle plates 208. For example, in this embodiment, stainless steel (SUS430) is used as the material of the fixing plate 300. The fixing plate 300 is formed preferably but not exclusively by bending, for example, so that the fixing plate 300 can be formed relatively easily and the bottom surface of the fixing plate 300 can stably be flattened. Alternatively, the fixing plate 300 can be formed, for example, by drawing. The bottom surface of the fixing plate 300 formed by drawing tends to warp easier than the one formed by bending, however, the strength of the fixing plate 300 is improved significantly when the fixing plate is formed by drawing. So the recording head modules 200 are protected more reliably by the fixing plate 300.

Figure 9:
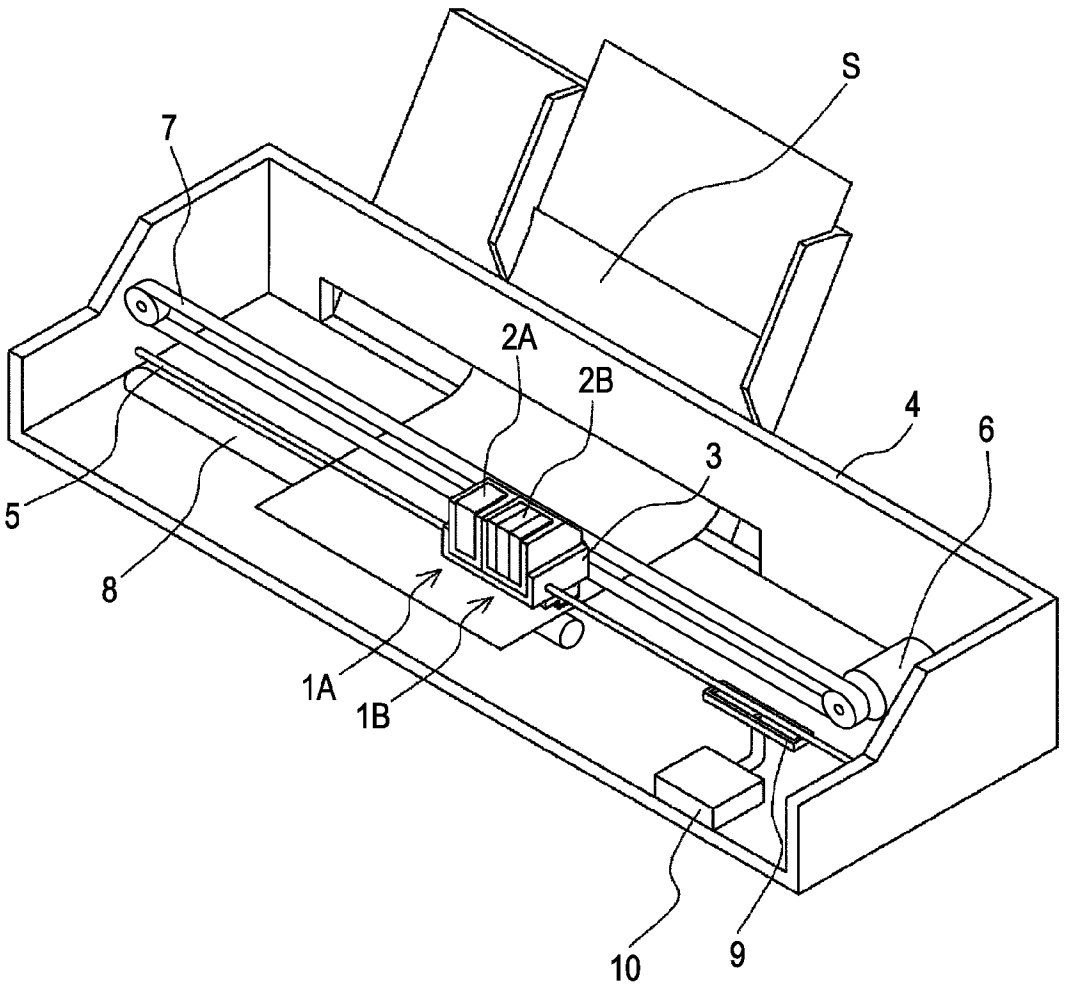
FIG. 9 is a schematic perspective view of the recording device according to the first embodiment.

The recording head 1 with the structure as described before is mounted on an ink jet recording device. Referring to FIG. 9 which is a schematic view of an example of the ink jet recording device, a carriage 3 carries recording heads 1A and 1B having the recording head modules of the type described. Ink cartridges 2A and 2B serving as ink supplying units are detachably mounted on the recording heads 1A and 1B, respectively. The carriage 3 mounting the recording heads 1A and 1B thereon is provided on a carriage shaft 5 attached to a device main body 4 so as to be movable in an axial direction of the shaft. Then, driving force of a driving motor 6 is transmitted to the carriage 3 through a train of gears (not shown) and a timing belt 7, so that the carriage 3 mounting the recording head 1 thereon moves along the carriage shaft 5. Meanwhile, a platen 8 is provided along the carriage shaft 5 in the device main body 4 and a recording sheet S which is a recording medium such as paper being fed by a paper feeding roller (not shown) or the like is conveyed on the platen 8.

Also, a cap member 9 for sealing a nozzle surface in which the nozzle orifices of the recording heads 1A and 1B open and a sucking mechanism 10 for sucking interior of the cap member 9 are provided at a position corresponding to a home position of the carriage 3, i.e. in the vicinity of one end portion of the carriage shaft 5. The cap member 9 prevents ink stagnant around the nozzle orifices 207 of the recording heads 1A and 1B from drying by sealing the nozzle surface of the recording heads 1A and 1B. At the same time, the cap member 9 serves as an ink catcher when the ink jet recording device performs, for example, a flushing operation for causing any residual ink to be expelled from the nozzle orifices 207 or, alternatively, a sucking operation by means of the sucking mechanism 10 for forcing any ink residue or the like to be drawn from the nozzle orifices by sucking interior of the cap member 9 at a suitable timing.

When the nozzle surface of the recording heads 1A and 1B are sealed by such cap member 9, contact between the cap member 9 and the recording head 1 (fixing plate 300) might cause deformation of the fixing plate 300 resulting in misalignment of the nozzle orifices 207 of the different modules. The misalignment causes ink droplets ejected from the nozzle orifices to be misdirected with respect to the ink-droplet landing positions. However, as described before, the reinforced portion 230 provided in the clearances between the adjacent recording head modules 200 and so on substantially stiffens the fixing plate 300 to eliminate the deformation of the fixing plate. Accordingly, it is possible to maintain high ink-droplet landing accuracy and, hence, high printing quality for a long period of service. Moreover, the deformation of the fixing plate 300 caused by the cure shrinkage can be prevented by forming the reinforced portion 230 using the adhesive with its hardness lower in cured state than that of the adhesive 350 for attaching the recording head modules 200 to the fixing plate 300. Also, providing the reinforced portion 230 in such a manner enhances the adhesion force, so improvement in durability of the recording head 1 can be achieved.

Moreover, the reinforced portion 230 substantially enhances the stiffness of the fixing plate 300, so that the deformation of the fixing plate 300 caused by weight of the recording head modules 200 can also be prevented. As described before, four recording head modules 200 are joined to the fixing plate 300 in this embodiment. The fixing plate 300 might be deformed by the weight of the recording head modules 200 because the thickness of the fixing plate 300 is relatively small. However, the reinforced portion 230 can prevent the deformation of the fixing plate 300 caused by the weight of the recording head modules 200.

Also, the adhesive filling the concaved portion 304 of the fixing plate 300 to form the reinforced portion 230 can prevent the ink from remaining in the concaved portion 304. The mist or the like of the ink droplets remaining in the concaved portion 304, which is ejected from the nozzle orifices 207, might disadvantageously attach to the recording medium such as paper. However, the reinforced portion 230 filling the concaved portion 304 does not allow the ink droplets to remain in the concaved portion 304, so that staining the recording medium, which otherwise may be caused by such droplets, can effectively be avoided.

Second Embodiment

Figure 10:
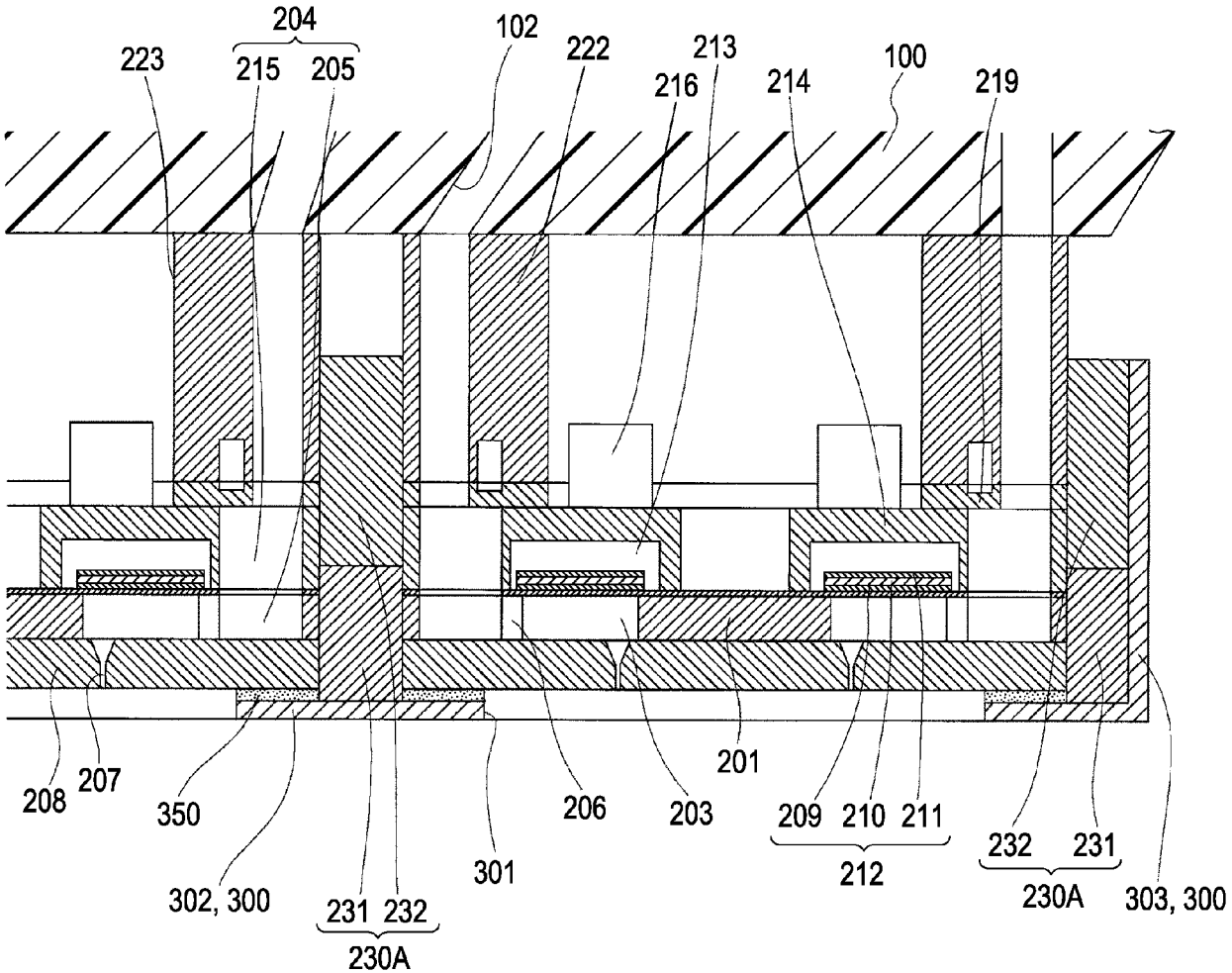
FIG. 10 is a sectional view of a critical part of a recording head according to a second embodiment.

FIG. 10 is a sectional view of the critical part of a recording head according to a second embodiment. This embodiment is exemplary embodiment wherein the structure of the reinforced portion in the first embodiment is modified and other structures are the same as those of the first embodiment. Specifically, a reinforced portion 230A employed in this embodiment is, as shown in FIG. 10, formed with two layers composed of a first layer 231 and a second layer 232 made of different adhesives and laminated in the thickness direction, in contrast to the first embodiment which employs the reinforced portion 230 formed with the single adhesive forming the entire reinforced portion continuously in the thickness direction. When the reinforced portion 230A is formed with the first layer 231 and the second layer 232, it is formed such that the adhesive forming the first layer 231 provided adjacent to the fixing plate 230 has higher hardness in cured state than that of the adhesive forming the second layer 232. That is, the materials of the layers forming the reinforced portion 230A are selected such that the layer positioned closer to the nozzle surface of the recording head 1 is formed with the adhesive having higher hardness in cured state. For example, in this embodiment, the first layer 231 is formed with epoxy adhesive and the second layer 232 is formed with silicone adhesive.

With such structure, the first layer 231 of the reinforced portion 230A enhances the stiffness of the fixing plate 300 without fail, so that the deformation of the fixing plate 300 can be prevented, which otherwise may occur during sealing the nozzle surface of the recording head 1 with the cap member 9. Also, forming the second layer 232 with the adhesive having relatively low hardness can also effectively prevent the deformation of the fixing plate 300 attributable to cure shrinkage of the adhesive forming the reinforced portion 230A.

Additionally, the proportion of the thickness of the first layer 231 to the second layer 232 in the reinforced portion 230A is not limited specifically. However, it is preferable that the first layer 231 is thinner than the second layer 232, so that the deformation of the fixing plate 300 attributable to cure shrinkage of the adhesive forming reinforced portion 230A is more reliably prevented.

Moreover, a too large thickness of the first layer 231 may disadvantageously cause the above described deformation of the fixing plate 300 due to cure shrinkage. Therefore, it is preferable that the first layer 231 is formed thin enough but thick enough to prevent the deformation of the fixing plate 300 caused when the cap member 9 touches the recording head 1, or it is preferable that the first layer 231 is formed at least thinner than the second layer 232. Especially, it is preferable that the first layer 231 is formed to have a thickness which does not allow the first layer to touch the head case 222. In this embodiment, it is preferable that the first layer is formed to have a thickness which allows the first layer to touch neither the head case 222 nor the compliance substrate 218. This is because, as described before, the head case 222 and the compliance substrate 218 are, for example, formed with stainless material (SUS), or a material more easily deformable comparing to the silicon made passage-forming substrate 201 and the like, and thus, if the first layer 231 touches them, the deformation of the head case 222 may occur due to cure shrinkage, resulting in the deformation of the fixing plate 300.

Figure 11A:
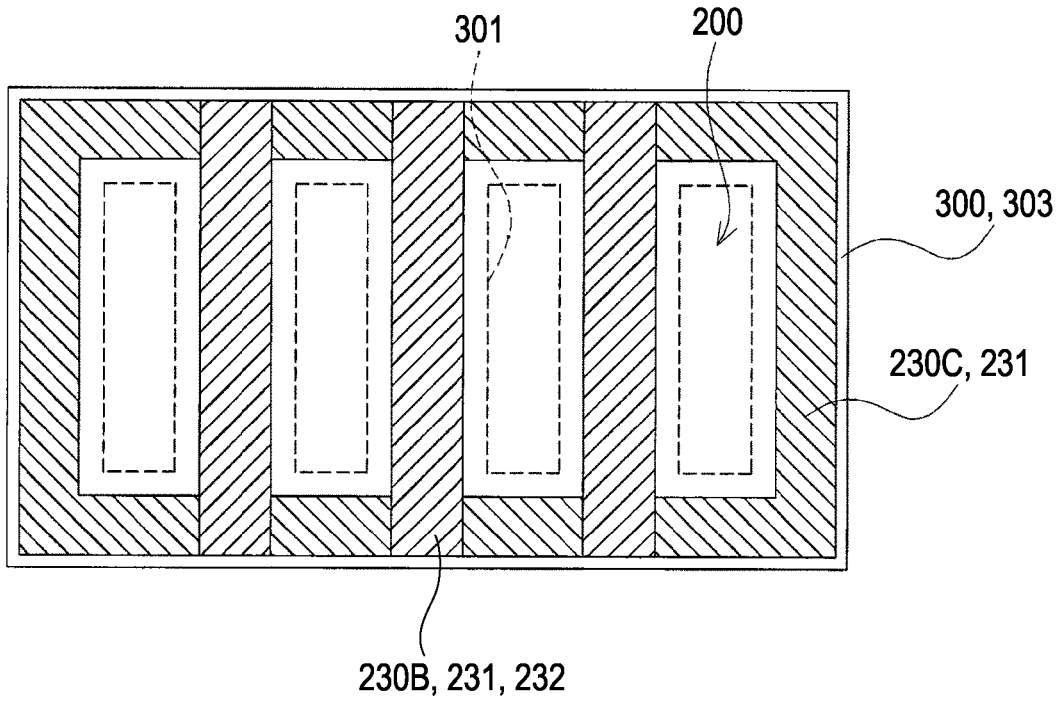
FIG. 11A is a plan view of a modification of the recording head according to the second embodiment.

In this embodiment, the entirety of the reinforced portion 230A has a multi-layered structure. This, however, is not exclusive. For example, as shown in FIG. 11A, only a reinforced portion 230B provided in the clearances between the adjacent recording head modules 200 may be formed in multi-layers. Specifically, the reinforced portion 230B provided in the clearances between adjacent recording head modules 200 is formed with the above described first layer 231 and second layer 232, and a reinforced portion 230C provided in the periphery of the fixing plate 300 is formed only with the first layer 231. By so doing, the substantial stiffness of the fixing plate 300 can be enhanced more reliably. Additionally, effect of the cure shrinkage of adhesive forming the reinforced portion 230C is relatively small at the peripheral portion of the fixing plate 300, so that the fixing plate 300 is not substantially deformed even when adhesive with high hardness in cured state is used as the adhesive forming the reinforced portion 230C.

Also, in this embodiment, the reinforced portion 230A, as well as the reinforced portion 230B, is formed with two layers, i.e. the first layer 231 and the second layer 232, however, each of these the reinforced portions may be formed with more than two layers. In this case, each of the layers forming the reinforced portion 230A and 230B is formed in a manner that the layer closer to the fixing plate 300 has higher hardness in cured state.

Third Embodiment

Figure 12:
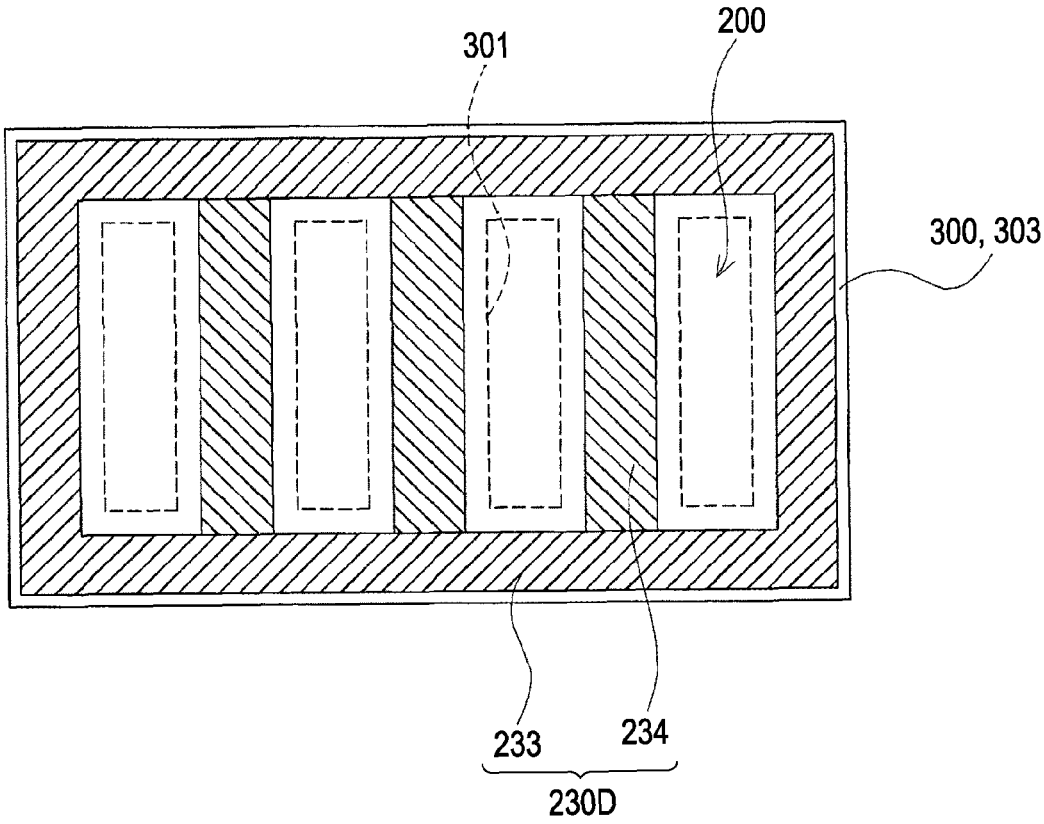
FIG. 12 is a schematic view illustrating a position on which a reinforced portion employed in a third embodiment is formed.

FIG. 12 is a schematic view illustrating a position at which a reinforced portion employed in a third embodiment is formed. This embodiment is an exemplary embodiment wherein the structure of the reinforced portion is modified. This embodiment is an example of the reinforced portion formed with different adhesives according to the region where the reinforced portion is formed. Except for the reinforced portion, structures employed in the third embodiment are the same as those of the first embodiment.

Figure 11B:
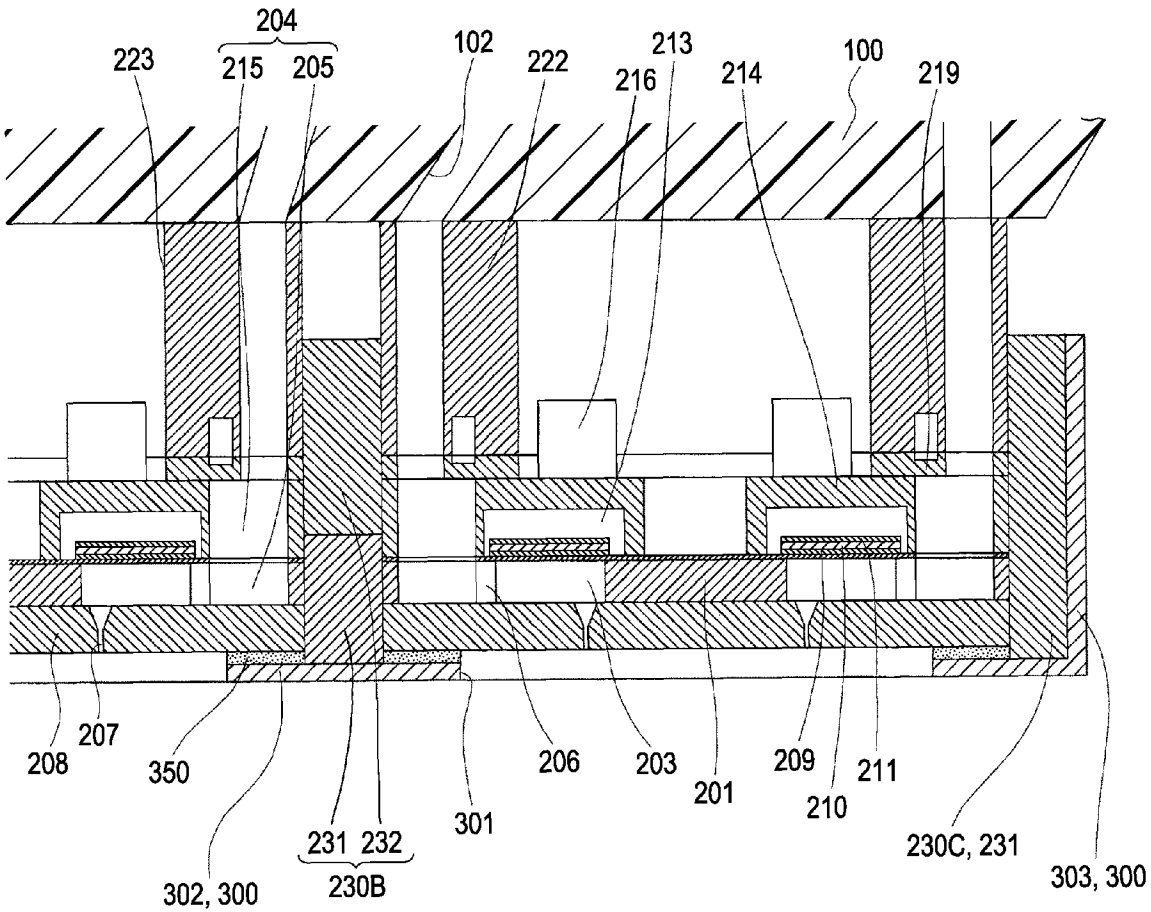
FIG. 11B is a sectional view of the modification of the recording head according to the second embodiment.

A reinforced portion 230D employed in this embodiment is, as shown in FIG. 12, composed of a first reinforced portion 233 provided in the clearance between the side wall portion 303 and the recording head modules 200, i.e. the peripheral portion of the fixing plate 300, and a second reinforced portion 234 provided in the clearances between adjacent recording head modules 200. The first reinforced portion 233 is formed with adhesive with higher hardness in cured state than that of the adhesive forming the second reinforced portion 234. For example, in this embodiment, the first reinforced portion 233 is formed with silicone adhesive and the second reinforced portion 234 is formed with epoxy adhesive. Additionally, in this embodiment, the second reinforced portion 234 is provided only in the clearances between adjacent recording head modules 200 while the first reinforced portion 233 is provided in the peripheral portion of the fixing plate 300 continuously. This arrangement, however, may be changed such that the second reinforced portion 234 extends from both sides in the longitudinal direction of the each recording head module 200 to the fixing plate 300, as is the case of the structure as shown in FIG. 11.

With this kind of reinforced portion 230D employed in this embodiment, as described above, the deformation of the fixing plate 300 caused when the cap member 9 touches the recording head 1 can be prevented, as well as the deformation of the fixing plate 300 caused by the cure shrinkage of the adhesive to be the reinforced portion 230D. In other words, the first reinforced portion 233 considerably enhances the stiffness of the peripheral portion of the fixing plate 300, which the cap member 9 touches, so that the deformation of the fixing plate 300 caused when the cap member 9 touches the recording head 1 is surely prevented. Also, the deformation of the fixing plate 300 caused by the cure shrinkage is also effectively prevented by forming the second reinforced portion 234 provided in the clearances between adjacent recording head modules 200 with the adhesive with relatively low hardness in cured state.

Other Embodiments

Although specific embodiments of the present invention have been described, these embodiments are only illustrative and various changes and modifications may be imparted thereto. For example, in the embodiment described above, the fixing plate 300 has the side wall portion provided on all around its periphery and the reinforced portion 230 provided along the entire periphery of the fixing plate 300. This arrangement, however, is not exclusive. That is, the arrangement may be such that the reinforced portion 230 is provided only along local portions of the periphery of the fixing plate 300, as well as in the clearances between recording head modules 200.

Figure 13:
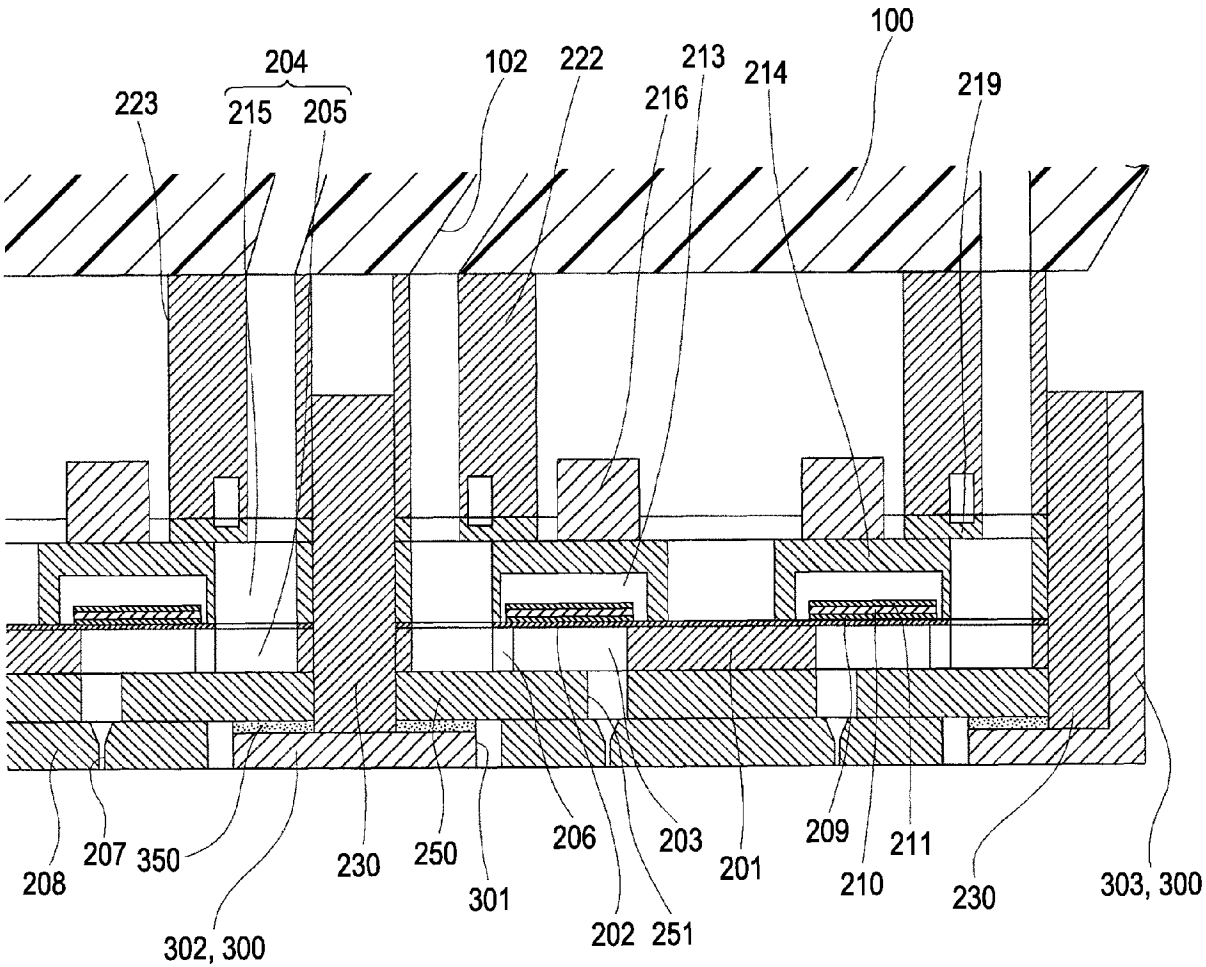
FIG. 13 is a sectional view of a critical part of another embodiments.

Additionally, in the foregoing the first embodiment, the nozzle plate 208 of the recording head modules 200 are bonded to the peripheral portions of the opening portions 301 of the fixing plate 300. This arrangement also is only illustrative. For example, the arrangement may be such that the bottom surface of the nozzle plate 208 of each recording module 200 protrudes in the thickness direction of the plate into the opening portion 301 of the fixing plate 300. Specifically, as shown in FIG. 13, a communicating plate 250 is provided between the passage-forming substrate 201 and the nozzle plate 208, the communicating plate 250 providing communication between spaces in the nozzle orifices 207 and the pressure-generating chamber 203. The fixing plate 300 is bonded to the communicating plate 250. Also, the nozzle plate 208 may have dimensions smaller than those of the opening portion 301 of the fixing plate 300, the passage-forming substrate 201 and the communicating plate 250, so that the nozzle plate 208 attached to the communicating plate 250 protrudes from the communicating plate 250 into the opening portion 301 of the fixing plate 300. Of course, the advantages of some aspects of the invention can be achieved with these arrangements. Ink-droplet landing accuracy can be improved because the distance between the nozzle plates 208 and the recording medium is shortened by forming the nozzle plate 208 so as to protrude from each recording head module 200 into the opening portion 301 of the fixing plate 300.

Moreover, in the above described embodiments, flexural oscillation type piezoelectric elements are exemplary illustrated as the pressure generating element for applying pressure to the liquid in the pressure generating chamber. However, types of the pressure generating elements are not limited. For example, the present invention may employ a longitudinal oscillation type piezoelectric elements, in which piezoelectric material and electrode formation material are alternately laminated, expanding and contracting in a direction perpendicular to the elastic film 202, an exothermic element, or the like.

The ink jet recording head ejecting ink droplets is exemplary described for illustration of the present invention in the described embodiments, however, the present invention widely relates to all kinds of liquid jet heads. Example of such liquid jet heads include a recording head used in an image recording device such as a printer, a color material jet head used in producing a color filter such as a liquid crystal display, an electrode formation material jet head used for forming electrodes of an organic EL display or a field emission display (FED), a living organic material jet head used for producing a biochip, and the like.

What is claimed is:

1. A liquid jet head comprising:

a plurality of head modules each having a nozzle plate with nozzle orifice formed therein, a passage-forming substrate having pressure-generating chamber therein, the chambers communicating with the associated nozzle orifices and pressurized by pressure generating element so as to eject droplets, and a head case placed at the side of the passage-forming substrate opposite to the nozzle plate, the head case having flow paths for providing a liquid to the pressure-generating chambers;

a fixing plate having openings through which the nozzle orifice are exposed and carrying the head modules positioned and fixed thereon;

a connecting member to which the surface of the head module adjacent to the head case is connected, the connecting member having flow paths which communicate with the pressure-generating chambers; and a reinforced portion made of an adhesive filling a clearance between adjacent head modules fixed to the fixing plate, wherein the fixing plate has a side wall portion protruding heightwise from the periphery of the bottom portion thereof, wherein the reinforced portion is also provided in a clearance between the side wall portion and the head modules, and wherein the height of the side wall portion is smaller than that of the head modules.

2. The liquid jet head according to claim 1, wherein the side wall portion is tall enough to reach the head case.

3. The liquid jet head according to claim 1, wherein the adhesive forming the reinforced portion has a lower viscosity in un-cured state and a lower hardness in cured state than those of an adhesive used for attaching the fixing plate to the nozzle plate.

4. The liquid jet head according to claim 1, wherein at least part of the reinforced portion has a laminated structure composed of a plurality of layers of different adhesives, the adhesive forming a layer closer to the bottom of the fixing plate having a hardness greater than that of the adhesive forming a layer adjacent to the head case in cured state.

5. The liquid jet head according to claim 1, wherein the reinforced portion includes a first layer closer to the bottom of the fixing plate and a second layer closer to the head case, the first layer being formed of an adhesive having higher hardness in cured state than an adhesive forming the second layer, the first layer being formed to have a thicknesswise height which does not allow the first layer to reach the head case.

6. The liquid jet head according to claim 1, wherein the reinforced portion includes a first layer closer to the bottom of the fixing plate and a second layer closer to the head case, the first layer being formed of an adhesive having higher hardness in cured state than an adhesive forming the second layer, and wherein the reinforced portion provided in the clearance between the side wall portion and the head modules is formed only of the first layer.

7. A liquid jet device having the liquid jet head according to claim 1.

* * * * *